United States Patent [19]

Konishi

[11] Patent Number: 4,988,049

[45] Date of Patent: Jan. 29, 1991

[54] AIR CAPACITY CONTROLLING METHOD FOR CENTRALIZED BLOWER SYSTEM

[75] Inventor: Yuji Konishi, Oumihachiman, Japan

[73] Assignee: Murata Kikai Kabushiki Kaisha, Kyoto, Japan

[21] Appl. No.: 212,525

[22] Filed: Jun. 28, 1988

[30] Foreign Application Priority Data

Jul. 8, 1987 [JP] Japan ..... 62-168586

[51] Int. Cl.[5] ..... B65H 54/20; B65H 54/22

[52] U.S. Cl. ..... 242/35.5 R; 242/35.6 R

[58] Field of Search ..... 242/35.5 R, 35.5 A, 242/35.6 R; 57/304, 305

[56] References Cited

U.S. PATENT DOCUMENTS 2,679,361 5/1954 Furst ..... 242/35.5 R
2,783,950 3/1957 Furst ..... 242/35.5 R
4,319,720 3/1982 Ueda ..... 242/35.5 R
4,773,208 9/1988 Wolf ..... 57/305

*Primary Examiner*—Stanley N. Gilreath
*Attorney, Agent, or Firm*—Spensley Horn Jubas & Lubitz

[57] ABSTRACT

An air capacity controlling method for a centralized blower system wherein a common suction air duct is connected to a plurality of winders such that suction air for operation may act upon the winders through the duct, and a preset number of suction blowers having a total air capacity corresponding to a total air quantity necessitated by the winders are connected in a parallel relationship, is constituted such that it is detected from a pressure of air within the duct that the total air quantity necessitated by the winders has varied, and the air capacity of the suction blowers is adjusted in accordance with such a detection value.

12 Claims, 3 Drawing Sheets

AIR CAPACITY CONTROLLING METHOD FOR CENTRALIZED BLOWER SYSTEM

FIELD OF THE INVENTION

This invention relates to an air capacity controlling method for a centralized blower system, and more particularly to an air capacity controlling method for a centralized blower system of the type wherein a common suction air duct is connected to a plurality of winders and a preset number of suction blowers having a total air capacity corresponding to a total air quantity necessitated by the winders are connected to the suction air duct, which method can attain balancing between a total air quantity necessitated by the winders and a total suction air capacity of the suction blowers when the total air quantity necessitated by the winders is caused to fluctuate, for example, by break of a yarn on some of the winders.

RELATED ART STATEMENT

Generally, in a winder for winding a yarn on a bobbin to form a package, a suction blower is connected to the winder in order to attain splicing of a yarn when break of the yarn or the like occurs. A suction blower system of the type just mentioned frequently employs such a construction as shown in FIG. 3.

Referring to FIG. 3, a plurality of winders 101 for forming packages thereon are installed and interconnected by way of a common suction air duct 102.

A plurality of suction blowers 104 are connected to the suction air duct 102. The suction blowers 104 are connected in a parallel relationship by way of a header 103 as shown in FIGS. 3 and 4. In the arrangement shown, up to four suction blowers 104 are connected.

The suction blowers 104 cause suction air openings formed in the winders to suck air therethrough to cause suction air for operation to act upon the winders in order to attain splicing of yarns and the like on the winders 101. Meanwhile, the suction blowers 104 are controlled such that a selected number of them may operate depending upon a total air quantity necessitated by the winders in order that they may suck air of a quantity corresponding to the total air quantity necessitated by the winders 101.

More particularly, the number of those of the suction blowers 104 which are to operate is calculated from a total air quantity necessitated by the winders 101 and may be set with a margin such that the operating suction blowers 104 may have a total air capacity sufficiently greater than the total air quantity necessitated by the winders 101. For example, when all of the winders 101 are operating, the operating suction blowers 104 have a total air capacity sufficiently greater than the total necessitated air quantity. Thus, if a number of operating ones of the suction blowers 104 is calculated, the number obtained may be a value having a decimal point. In this case, the fraction is raised to obtain an integer, and the integral number of the suction blowers 104 are caused to operate.

By the way, the total air quantity actually necessitated by the winders exhibits fluctuations from various causes.

For example, the winders 101 may be link winders, in which winders are connected to spinning frames, for production in a small quantity which are operated independently of each other. In this instance, some percents of the link winders may stop and wait to receive supply of a yarn from a spinning frame or frames. Accordingly, the actually total necessitated air quantity may become smaller than the calculated total necessitated air quantity. The necessitated air quantity fluctuates also when break of yarns occurs frequently on the winders 101 or when some of the winders 101 are stopped for maintenance thereof.

Accordingly, there is a problem that the number of operating ones of the suction blowers 104 which is set with a margin in calculation becomes greater or smaller than a necessary one due to a fluctuation of the total air quantity necessitated by the winders 101.

OBJECT AND SUMMARY OF THE INVENTION

It is an object of the present invention to provide an air capacity controlling method for a centralized blower system wherein a number of suction blowers are operated depending upon a total air quantity necessitated by winders, which method can set an air capacity of the suction blowers in accordance with an amount of fluctuation in the total air quantity necessitated by the winders to attain saving of energy of the suction blowers.

According to the present invention, an air capacity controlling method for a centralized blower system wherein a common suction air duct is connected to a plurality of winders such that suction air for operation may act upon the winders through the duct, and a preset number of suction blowers having a total air capacity corresponding to a total air quantity necessitated by the winders are connected in a parallel relationship, is constituted such that it is detected from a pressure of air within the duct that the total air quantity necessitated by the winders has varied, and the air capacity of the suction blowers is adjusted in accordance with such a detection value. The air capacity controlling method can thus attain saving of energy of the suction blowers by setting the air capacity of the suction blowers depending upon a fluctuating total air quantity necessitated by the winders.

DETAILED DESCRIPTION OF PREFERRED EMBODIMENTS

An embodiment of the present invention will be described in detail below with reference to the accompanying drawings.

Figure 1:
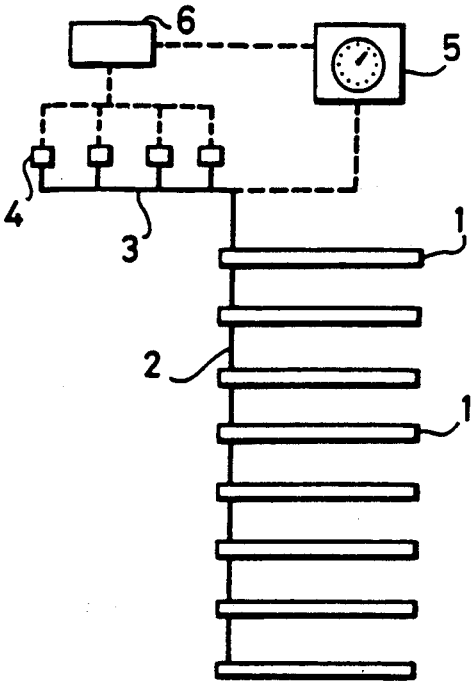
FIG. 1 is a view showing a suction blower system according to the present invention, FIG. 2 a block diagram illustrating contents of control of the suction blower system, FIG. 3 a view showing a conventional suction blower system, FIG. 4 a schematic view showing a conventional suction blower, and FIG. 5 a diagram illustrating characteristics of a blower.
Figure 3:
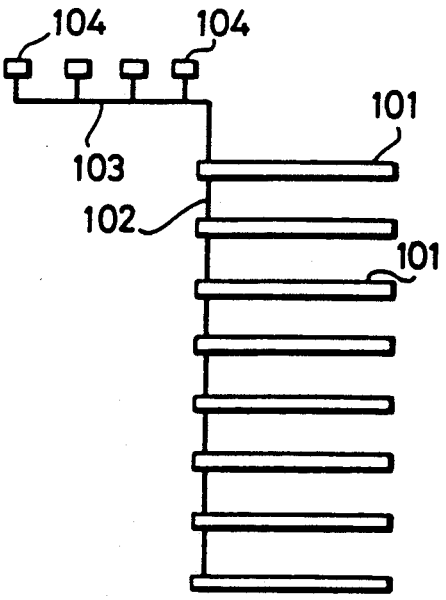
FIG. 3 PRIOR ART
Figure 4:
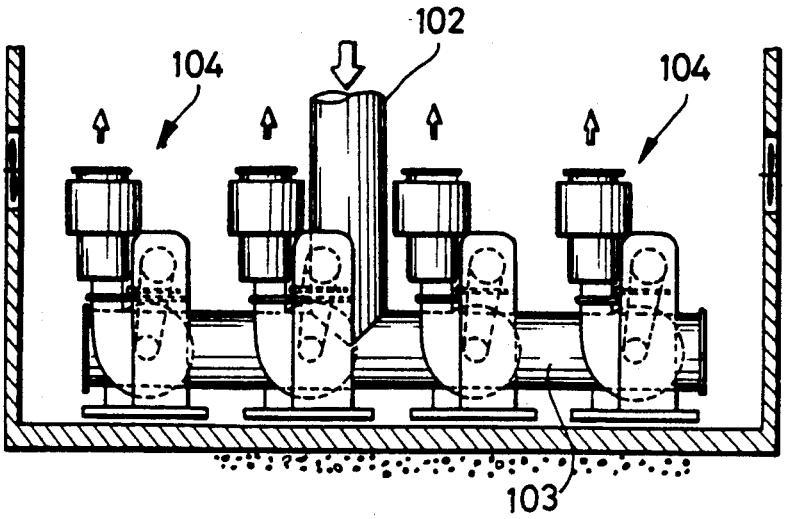
FIG. 4 PRIOR ART

As shown in FIG. 1, a plurality of winders 1 are connected to each other by way of a common suction air duct 2, and a plurality of suction blowers 4 are connected in a parallel relationship to the suction duct 2 by way of a header 3.

The suction blowers 4 cause suction air for operation to act upon the winders 1 via the suction duct 2. The suction blowers 4 are controlled such that a selected number of them may operate depending upon a total air quantity necessitated by the winders 1.

More particularly, a pressure gauge 5 is provided for the suction duct 2 for detecting a pressure of air within the header 3. In the present embodiment, the pressure gauge 5 is in the form of a static pressure gauge with a contact which detects a variation in static pressure of air which varies due to a fluctuation in the total air quantity necessitated by the winders 1. In particular, the pressure gauge 5 detects, for example, that the static pressure within the suction air duct 2 rises to a value higher than a predetermined level and that the static pressure lowers to a value lower than another predetermined level.

A controller 6 is connected to the pressure gauge 5 and determines, from a signal transmitted thereto from the pressure gauge 5, the number of those of the suction blowers 4 which are to operate. In particular, if the static pressure rises beyond the predetermined level, this means that the total air quantity necessitated by the winders 1 has decreased. In this instance, one of those of the suction blowers 4 which are operating is stopped. On the contrary, if the static pressure lowers beyond the other predetermined level, the number of those of the suction blowers 4 which are to operate is controlled such that it may be increased by one.

Subsequently, the air capacity controlling method of the present invention will be described.

Figure 2:
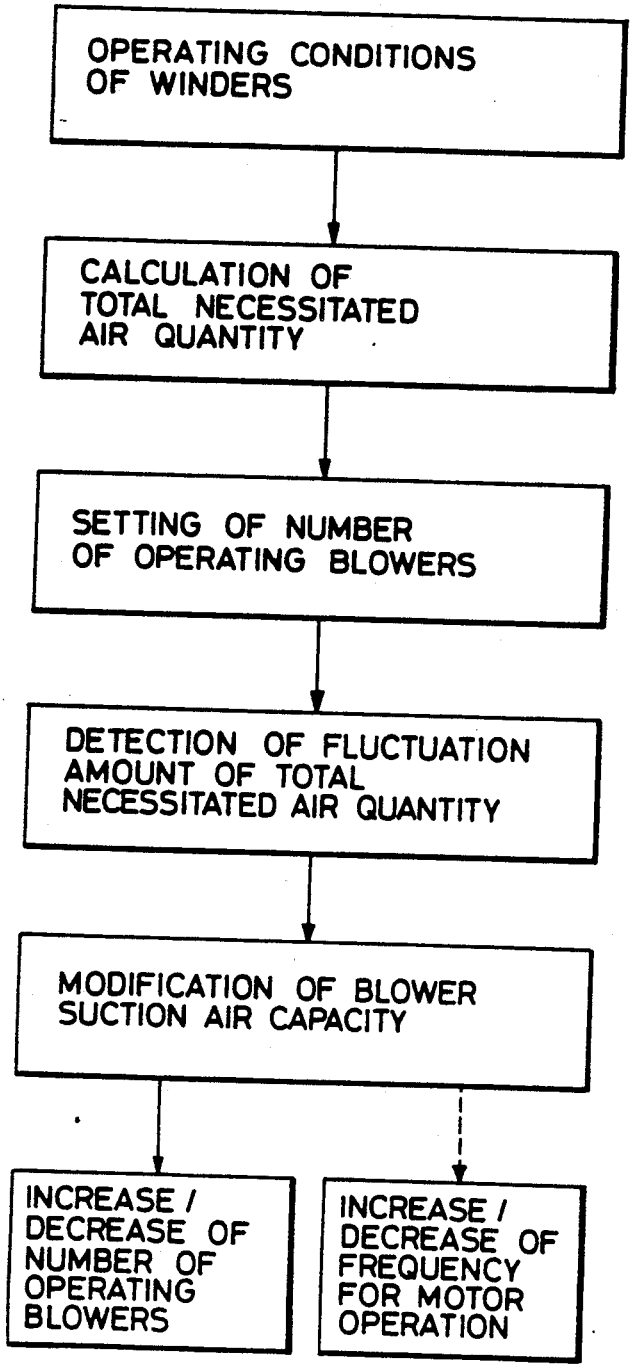

As shown in FIGS. 1 and 2, at first the winders 1 are rendered operative, and the air quantity necessitated for the operating conditions of the winders 1 is calculated and a number of the suction blowers 4 conforming to the total necessitated air quantity thus calculated are rendered operative.

After then, if the total necessitated air quantity on the winders 1 side for yarn splicing or the like varies, then the suction air capacity of the suction blowers 4 will be increased or decreased in response to such an amount of variation. In the present embodiment, the number of operating ones of the suction blowers 4 is controlled.

At first, the static pressure within the header 3 is detected by the pressure gauge 5 connected to the header 3. The amount of variation in the total necessitated air quantity on the winders 1 side is represented indirectly by the static pressure.

The pressure gauge 5 has two static pressure points set in advance therein, and when either one of the static pressure points is reached, the pressure gauge 5 delivers a signal to the controller 6. For example, an upper limit value of −900 mmAq and a lower limit value of −700 mmAq are preset in the pressure gauge 5.

Accordingly, when a signal of the pressure gauge 5 is received which represents that the static pressure reaches either the upper limit value or the lower limit value, the controller 6 controls to increase or decrease the number of operating ones of the suction blowers 4. In particular, if the pressure gauge 5 detects that the static pressure value of the upper limit (−900 mmAq) is reached, this means that the total necessitated air quantity on the winders 1 side has decreased. Accordingly, in this case, the number of operating ones of the suction blowers 4 is decreased by one.

To the contrary, if the static pressure lowers to the lower limit value (−700 mmAq), this means that the total necessitated air quantity on the winders 1 side has increased, and accordingly the number of operating ones of the suction blowers 4 is automatically increased by one.

Accordingly, if the total necessitated air quantity on the winders 1 side fluctuates after the number of operating ones of the suction blowers 4 has been set depending upon the operating conditions of the winders 1, the number of operating ones of the suction blowers 4 is controlled to be increased or decreased in accordance with such an amount of fluctuation. In this manner, the number of operating ones of the suction blowers 4 which has been set once will be modified later.

Thus, according to the present invention, as the number of operating ones of the suction blowers 4 is set in accordance with an amount of variation in the total air quantity necessitated by the winders 1 to adjust the air capacity of the suction blowers 4, unnecessary ones of the suction blowers 4 will not be caused to operate at all, and accordingly saving of energy of the suction blowers can be attained.

Further, since the total necessitated air quantity on the winders 1 side is well balanced to the suction air capacity of the suction blowers 4, it is possible to assure an air quantity of a plurality of operating ones of the suction blowers 4 which is higher than a minimum value.

Figure 5:
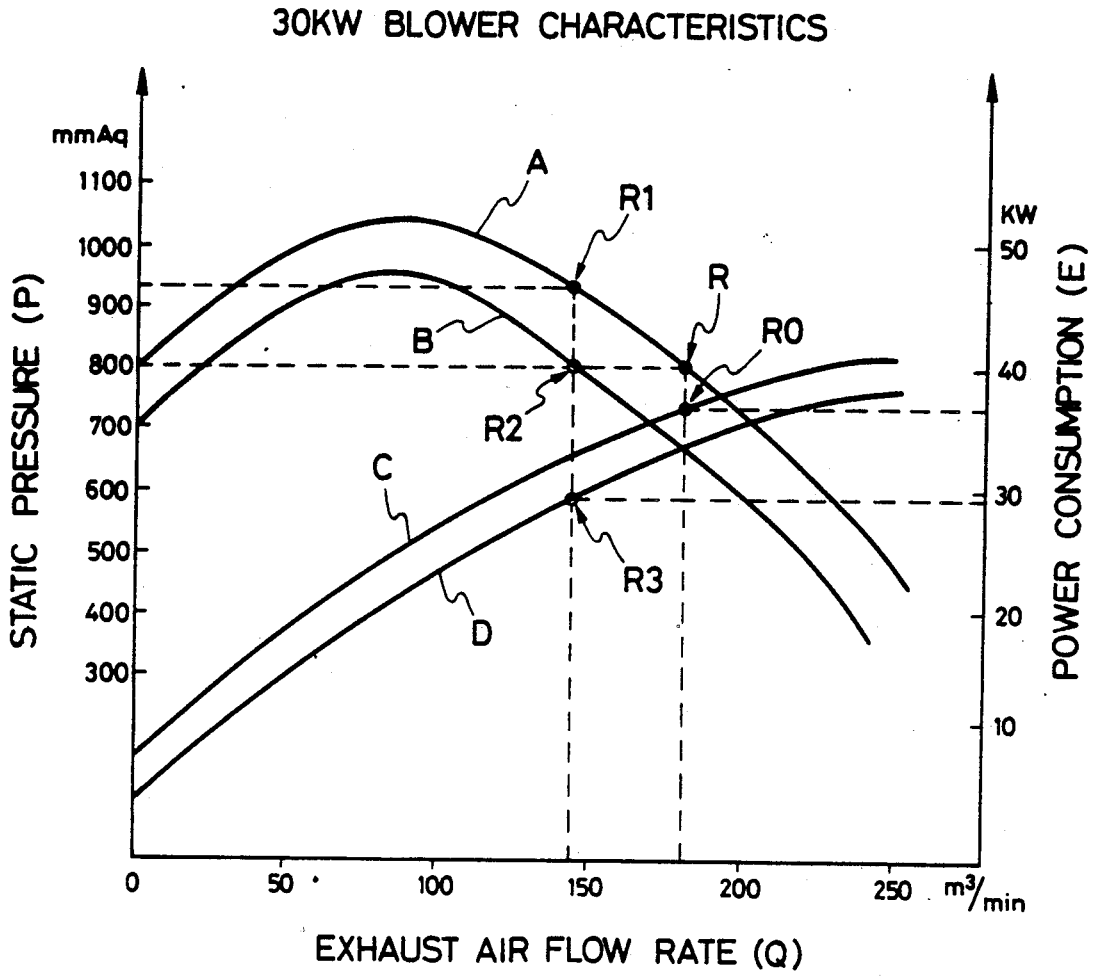

According to another embodiment, where motors of the winders 1 are designed such that the frequency for operation thereof may be controlled by means of an invertor circuit, the frequency for operation of the motors is controlled in order to adjust the air quantity of the suction blowers 4. In particular, the number of operating ones of the suction blowers 4 is not increased nor decreased, but the frequency for operation of the motors of the individual suction blowers 4 is controlled in accordance with an amount of fluctuation in the total air quantity necessitated by the winders 1. Control in this instance will be described with reference to a blower characteristic diagram of FIG. 5.

Exemplary relationships between the exhaust air flow rate Q and the static pressure P of air of a single blower (a 30 kW blower, here) are indicated by curves A and B while exemplary relationships between the exhaust air flow rate Q and the power consumption E are indicated by curves C and D. The curve A of FIG. 5 indicates a Q–P relationship where the rotational speed N of a motor is 3,500 r.p.m., and the power consumption then is indicated by the curve C. Meanwhile, the curve B is a Q–P curve where the rotational speed (N=3,500 r.p.m.) of the motor is decreased by 5%, that is, where the rotational speed is 3,325 r.p.m., and the power consumption curve then is indicated at D.

It is assumed here that the conditions of the point R on the curve A are optimum conditions during normal operation of the blower described just above. Now, if the static pressure P rises to a value of a point R1 because some winding units on the winders side are stopped or from some other cause, then the static pressure will rise above the optimum value of 800 mmAq and is of no use. Accordingly, in case such a rise of the stating pressure is detected, the rotational speed of the blower motor will be decreased, by invertor control or by frequency control, by 5% or by a value determined by an operating device, for example, to a value on the characteristic curve B. In particular, on the curve B, the motor is operated in the conditions at a point R2 which presents the same static pressure as at the point R of the curve A, and the power consumption then is indicated at a point R3 and presents a value smaller than the power consumption at a point R0 (about 37 kW).

Where operation of the blowers is controlled by such frequency control, since rotation of the individual blower motors can be controlled indefinitely, fine control can be attained comparing with the preceding embodiment wherein the motors are turned on or off one by one.

In other words, where the blowers are driven by such a small number of motors as one or two, it is difficult to control the static pressure in such a manner that it may be substantially constant in response to a variation in the static pressure on the winder side. Accordingly, where the number of motors is comparatively small, frequency control is preferable, but on the contrary where the number of motors is comparatively great, control depending upon increase or decrease of the number of operating ones of the motors is suitable.

Meanwhile, where the winders 1 are in the form of link winders, such a constitution is also possible that suction air for operation may not be allowed to act upon those of the link winders which are stopped or not operated because of inspection or repair of the winders.

Normally, a yarn trap defining a sucking opening for sucking an end of a yarn therethrough is open on each of the link winders even when the link winder is stopped or not operated because of inspection or repair of the winders. Accordingly, when the suction blowers 4 are operating, air is sucked in also through those link winders which are stopped or not operated because of inspection or repair of the winders, and the air of the quantity sucked by way of those link winders is of no use. Thus, according to the present invention, opening and closing valves are provided for suction air ducts not shown of the individual link winders. When a link winder is stopped or not operated because of inspection or repair of the winders, the opening and closing valve therefor closes the entrance of the suction air duct of the link winder. In this instance, the opening and closing valve will make a closing operation when it detects that the link winder is stopped or not operated because of inspection or repair of the winders.

By eliminating air consumption on a link winder or winders stopped or not operated because of inspection or repair of the winders in this manner, the overall waste of air by all of the winders can be eliminated. Accordingly, with the suction blower system, the air capacity can be reduced, and consequently the number of operating ones of the suction blowers 4 or the rotational speed of operation of the motors can be reduced. Accordingly, saving of energy can be attained.

It is to be noted that, in the present invention, a static pressure gauge not shown may be provided for each of the winders 1.

In particular, on the winders 1 side, in case, for example waste of yarn is accumulated by an excessively great amount the static pressure will be reduced to give rise to an obstacle to sucking of an end of a yarn. Thus, a static pressure gauge is connected to each of the winders 1 and an alarm is connected to the static pressure gauge such that, when the static pressure is decreased, for example, to −600 mmAq, the alarm may give a warning that an irregular condition has occurred to the winder 1 side. It is to be noted that when the static pressure is decreased to an extraordinarily low level, the winder 1 will be stopped.

As a summary of the foregoing description, according to the present invention, the air capacity of suction blowers is adjusted in accordance with an amount of variation of the total air quantity necessitated by winders. Accordingly, good balancing between the total air quantity necessitated by the winders and the suction air capacity of the suction blowers can be anticipated, and saving of energy of the blower system can be attained.

What is claimed is:

1. An air capacity controlling method for a centralized blower system wherein air is supplied under pressure by a fan having a motor, the motor being operated at a rotational speed by an electrical current supplied at a frequency, the air being supplied to a duct connected to a plurality of winders, the method comprising the steps of:

detecting a pressure of the air within the duct, and adjusting the frequency of the current to adjust the rotational speed of the motor in response to the detected pressure.

2. An air capacity controlling method for a centralized blower system according to claim 1, wherein the blower system includes a plurality of selectively operable fans, further comprising the step of changing a number of operating ones of the fans in response to the detected pressure.

3. An air capacity controlling method for a centralized blower system according to claim 1, wherein the step of detecting the pressure further comprises the step of comparing the detected pressure to a predetermined value.

4. An apparatus for controlling a blower system having air forcing means, controlled by a motor, for forcing air, at a pressure determined by the rotational speed of the motor, through a conduit to a plurality of winders, the apparatus comprising:

sensing means for sensing the pressure of the air in the conduit;

comparing means for comparing the sensed pressure to a reference pressure;

determining means for determining a pressure difference between the sensed pressure and the reference pressure; and first adjusting means for adjusting the rotational speed of the motor from a first rotational speed to a second rotational speed when the pressure difference is greater than a predetermined value, wherein the first and second rotational speeds are greater than 0 rpm.

5. An apparatus for controlling a blower system as claimed in claim 4, wherein the air forcing means comprises a fan.

6. An apparatus for controlling a blower system as claimed in claim 4, wherein the first adjusting means comprises:

supply means for supplying electrical current at a variable frequency to the motor, and second adjusting means for adjusting the frequency of the supplied current, to adjust the rotational speed of the motor.

7. An apparatus for controlling a blower system as claimed in claim 6, wherein the second adjusting means further comprises an invertor control means.

8. An apparatus for controlling a blower system having air forcing means for forcing air at a pressure through a conduit to a plurality of winders, comprising:

sensing means for sensing the pressure of the air in the conduit;

comparing means for comparing the sensed pressure to a reference pressure;

determining means for determining a pressure difference between the sensed pressure and the reference pressure; and first adjusting means for adjusting the air forcing means when the pressure difference is greater than a predetermined value;

wherein the air forcing means further comprises a motor for driving a fan at a rotational speed, and the first adjusting means comprises second adjusting means for adjusting the rotational speed of the driving means;

wherein the second adjusting means further comprises:

supply means for supplying electrical current at a variable frequency to the motor, and third adjusting means for adjusting the frequency of the supplied current, to adjust the rotational speed of the motor.

9. An apparatus for controlling a blower system as claimed in claim 8, wherein the third adjusting means further comprises an invertor control means.

10. A method for controlling a blower system having air forcing means, controlled by a motor, for forcing air, at a pressure determined by the rotational speed of the motor, through a conduit to a plurality of winders, the method comprising the steps of:

sensing the pressure of the air in the conduit, comparing the sensed pressure to a reference pressure, determining a pressure difference between the sensed pressure and the reference pressure, adjusting the rotational speed of the motor from a first rotational speed to a second rotational speed when the pressure difference is greater than a predetermined value, wherein the first and second rotational speeds are greater than 0 rpm.

11. A method for controlling a blower system as claimed in claim 10, wherein the step of adjusting the rotational speed of the motor further comprises the steps of:

supplying electrical current at a variable frequency to the motor, adjusting the frequency of the supplied current to adjust the speed of the motor.

12. A method for controlling a blower system having air forcing means for forcing air at a pressure through a conduit to a plurality of winders, the method comprising the steps of:

sensing the pressure of the air in the conduit;

comparing the sensed pressure to a reference pressure;

determining a pressure difference between the sensed pressure and the reference pressure;

adjusting the air forcing means when the pressure difference is greater than a predetermined value;

wherein the air forcing means has a motor for driving a fan at a rotational speed, and the step of adjusting the air forcing means further comprises the step of adjusting the rotational speed of the motor; and wherein the step of adjusting the rotational speed of the motor further comprises the steps of:

supplying electrical current at a variable frequency to the motor, and adjusting the frequency of the supplied current to adjust the speed of the motor.

* * * * *